US006597270B2

(12) United States Patent
Takashima et al.

(10) Patent No.: US 6,597,270 B2
(45) Date of Patent: Jul. 22, 2003

(54) MULTILAYER IMPEDANCE COMPONENT

(75) Inventors: Koichi Takashima, Fukui (JP); Hiromichi Tokuda, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/076,393

(22) Filed: Feb. 19, 2002

(65) Prior Publication Data

US 2002/0121957 A1 Sep. 5, 2002

(30) Foreign Application Priority Data

Feb. 19, 2001 (JP) ..... 2001-042492
Jan. 10, 2002 (JP) ..... 2002-003296

(51) Int. Cl.[7] ..... H01F 27/02
(52) U.S. Cl. ..... 336/83; 336/200
(58) Field of Search ..... 336/65, 83, 200, 336/206–208, 221, 222, 223, 232, 192; 29/602.1, 609; 257/531

(56) References Cited

U.S. PATENT DOCUMENTS 5,225,969 A * 7/1993 Takaya et al. ..... 336/200
6,498,553 B1 * 12/2002 Tanaka et al. ..... 336/83

FOREIGN PATENT DOCUMENTS

| | | |
|---|---|---|
| JP | 2-81410 | * 3/1990 |
| JP | 2-310905 | * 12/1990 |
| JP | 6-176928 | * 4/1994 |
| JP | 6-168825 | * 6/1994 |

* cited by examiner

*Primary Examiner*—Tuyen T. Nguyen
(74) *Attorney, Agent, or Firm*—Keating & Bennett, LLP

(57) ABSTRACT

A multilayer impedance component which has no directivity when mounted and which achieves outstanding electrical characteristics includes a high permeability coil having a first winding portion and a third winding portion defined by stacking relatively high permeability magnetic sheets, a low permeability coil having a second winding portion defined by stacking relatively low permeability magnetic sheets, and an intermediate layer defined by an intermediate sheet. The three winding portions are electrically connected in series with each other to define a helical coil. Each end of the helical coil is led from coil conductor patterns provided in the high-permeability coil to each of input and output external electrodes.

10 Claims, 4 Drawing Sheets

MULTILAYER IMPEDANCE COMPONENT

BACKGROUND OF THE INVENTION

1. Field of the Invention

The present invention relates to multilayer impedance components, and more particularly, to multilayer impedance components incorporated in various types of electronic circuits that are used as noise filters.

2. Description of the Related Art

Conventional multilayer impedance components are described, for example, in Japanese Unexamined Patent Application Publication No. 9-7835 and Japanese Unexamined Utility Model Publication No. 6-82822. Each of the multilayer impedance components described in these publications includes a multilayer structure defined by stacking a plurality of coils having different permeabilities. In addition, coil conductor patterns of the coils are electrically connected in series with each other to define a helical coil. In the multilayer impedance component, high impedance is maintained in a wide frequency region from low frequencies to high frequencies such that a noise eliminating frequency band is expanded.

However, in such a multilayer impedance component electrical characteristics change depending upon which of two upper and lower coils having different permeabilities arranged in the multilayer structure is positioned on a mounted-surface side when mounting the impedance element on a printed circuit board.

Additionally, when a pulse signal was input to the multilayer impedance component, research conducted by the inventors of the present invention showed differences in electrical characteristics between when the coil conductor patterns of the high permeability coil section are electrically connected to input and output external electrodes and when the coil conductor patterns of the low permeability coil section are electrically connected to the input and output external electrodes.

SUMMARY OF THE INVENTION

In order to overcome the above-described problems, preferred embodiments of the present invention provide a multilayer impedance component having electrical characteristics that do not change regardless of the mounting orientation of the multilayer impedance component, and further provide a multilayer impedance component having excellent electrical characteristics.

According to a first preferred embodiment of the present invention, a multilayer impedance component includes a high permeability coil unit having at least a first winding portion and a third winding portion defined by stacking a plurality of magnetic layers made of a relatively high permeability material and a plurality of coil conductor patterns, and a low permeability coil unit including at least a second winding portion defined by stacking a plurality of magnetic layers made of a relatively low permeability material and a plurality of coil conductor patterns. The high permeability coil unit and the low permeability coil unit are stacked such that the first, second, and third winding portions are electrically connected in series in a sequential manner to define a coil, the first winding portion and the third winding portion of the high-permeability coil unit are connected to input and output external electrodes.

According to a second preferred embodiment of the present invention, a multilayer impedance component includes a first high permeability coil unit including at least a first winding portion defined by stacking a plurality of magnetic layers made of a relatively high permeability material and a plurality of coil conductor patterns, a low permeability coil unit including at least a second winding portion defined by stacking a plurality of magnetic layers made of a relatively low permeability material and a plurality of coil conductor patterns, a second high permeability coil unit including at least a third winding portion defined by stacking a plurality of magnetic layers made of a relatively high permeability material and a plurality of coil conductor patterns. The low permeability coil unit is arranged between the first high permeability coil unit and the second high permeability coil unit such that the first, second, and third winding portions are electrically connected in series in a sequential manner to define a coil, the first winding portion of the first high permeability coil unit and the third winding portion of the second high permeability coil unit are connected to input and output external electrodes.

With the above-described unique arrangement, when a signal of a pulse wave is input to the multilayer impedance component, the signal waveform is blunt in the winding portion of the high permeability coil and thereafter, the waveform is distorted in the winding portion of the low permeability coil. If the coil conductor patterns of the low permeability coil are electrically connected to the input and output external electrodes, the signal waveform is distorted in the low permeability coil and thereafter, the waveform is blunt in the high permeability coil.

When the signal is closer to the pulse wave, the distortion increases. Accordingly, the distortion is greater in a multilayer impedance component having a configuration in which a pulse-wave signal input from input and output external electrodes propagates from a low permeability coil to a high permeability coil. In other words, electrical characteristics are greatly improved in the multilayer impedance component having a configuration in which the coil conductor patterns of the high permeability coil are electrically connected to the input and output external electrodes.

In addition, when the first and third winding portions of the high-permeability coil are connected to the input and output external electrodes, the electrical characteristics are substantially the same regardless of the mounting direction.

Furthermore, an intermediate layer made of a nonmagnetic material is preferably provided between the high permeability coil unit and the low permeability coil unit. Additionally, intermediate layers made of a nonmagnetic material are preferably provided between the first and second high permeability coil units and the low permeability coil unit. The intermediate layer prevents the electromagnetic coupling between magnetic flux generated in the high permeability coil and magnetic flux generated in the low permeability coil. In addition, the intermediate layers prevent mutual diffusion between the materials of the high and low permeability coils, and further prevent warping and cracking from occurring due to the difference between the shrinkage ratios of the materials.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

A description will be given of preferred embodiments of a multilayer impedance component according to the present invention with reference to the attached drawings.

Figure 1:
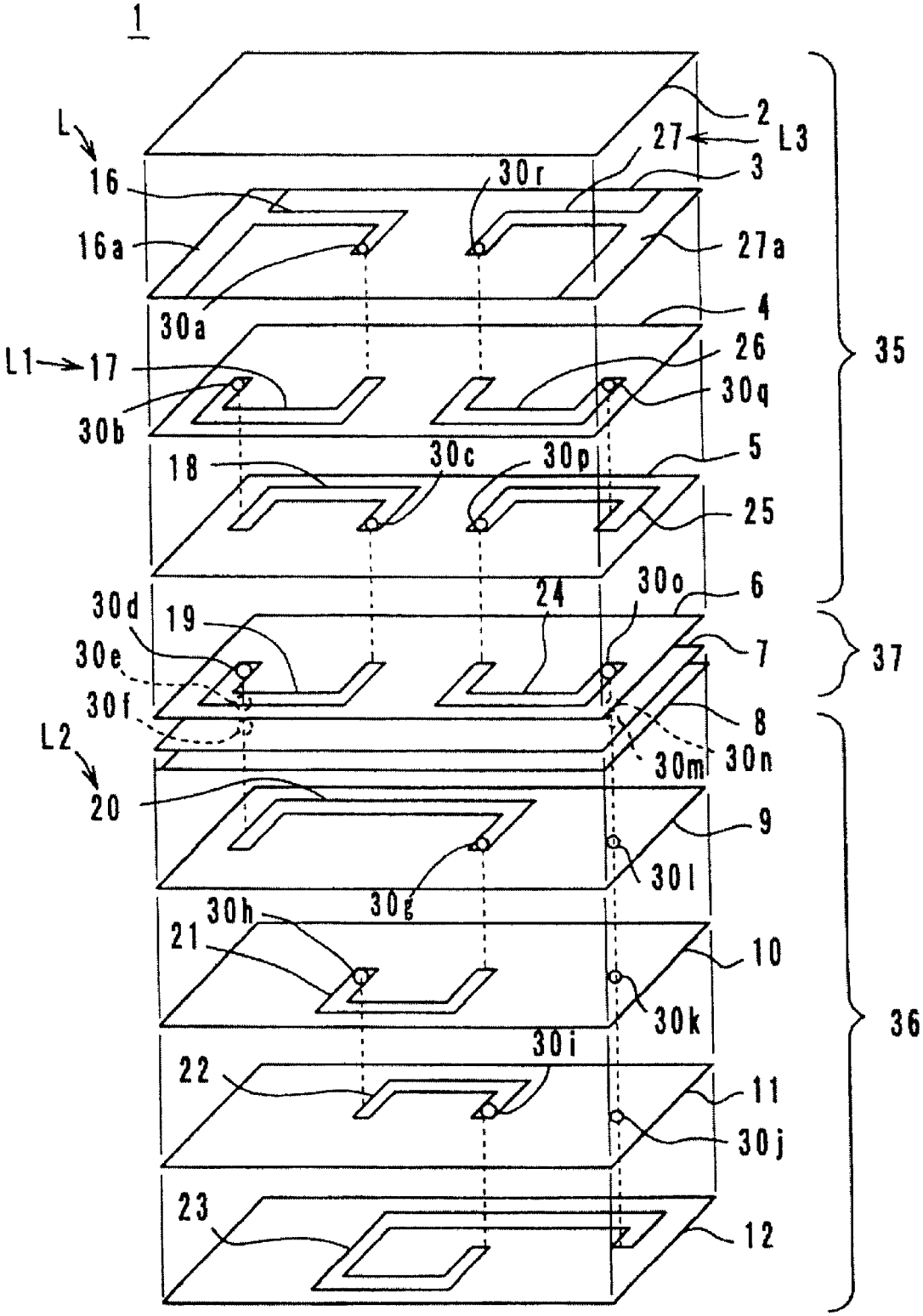
FIG. 1 is an exploded perspective view of a multilayer impedance component according to a first preferred embodiment of the present invention.

As shown in FIG. 1, a multilayer impedance component 1 according to a first preferred embodiment of the present invention preferably includes high permeability magnetic sheets 2 to 6 having coil conductor patterns 16 to 19 and 24 to 27 provided thereon, low permeability magnetic sheets 8 to 12 having coil conductor patterns 20 to 23 provided thereon and an intermediate sheet 7. The magnetic sheets 2 to 6 are defined by sheets made of insulative paste containing high permeability ferrite powder such as Ni—Cu—Zn ferrite or Mn—Zn ferrite. Similarly, the magnetic sheets 8 to 12 are defined by sheets made of insulative paste containing low permeability ferrite powder. In the first preferred embodiment of the present invention, the relative permeability $\mu$ of the high permeability magnetic sheets 2 to 6 is at least about 300 and the relative permeability $\mu$ of the low permeability magnetic sheets 2 to 6 is at least 100 or less. The intermediate sheet 7 is defined by a sheet made of insulative paste made of a nonmagnetic material such as glass or glass ceramic. Glass is more suitable than other insulative materials since it prevents mutual diffusion.

The coil conductor patterns 16 to 27 are made of Cu, Au, Ag, Ag—Pd, Ni, or other suitable material. The patterns 16 to 27 are electrically connected in series through via-holes 30*a* to 30*r* provided in the magnetic sheets 3 to 11 to define a substantially U-shaped helical coil L arranged inside the impedance element 1. More specifically, the coil conductor patterns 16 to 19 are connected in series through the via-holes 30*a* to 30*c* to define a first winding portion L1 of the high permeability coil 35. The coil conductor patterns 20 to 23 are connected in series through the via-holes 30*g* to 30*i* to define a second winding portion L2 of the low permeability coil 36. The coil conductor patterns 24 to 27 are connected in series through the via-holes 30*p* to 30*r* to define a third winding portion L3 of the high permeability coil 35.

The first winding portion L1 and the second winding portion L2 are wound in a clockwise direction from the upper-surface side of the impedance element 1. The third winding portion L3 is wound in a counterclockwise direction. The first winding portion L1 and the second winding portion L2 are electrically connected in series through the via-holes 30*d* to 30*f*. The second winding portion L2 and the third winding portion L3 are electrically connected in series through the via-holes 30*j* to 30*o*. A leading end 16*a* of the coil conductor pattern 16 is exposed on the left edge of the magnetic sheet 3. A leading end 27*a* of the coil conductor pattern 27 is exposed on the right edge of the magnetic sheet 3. The coil conductor patterns 16 to 27 are provided on surfaces of the magnetic sheets 3 to 6 and 9 to 12 by printing or other suitable methods.

Figure 2:
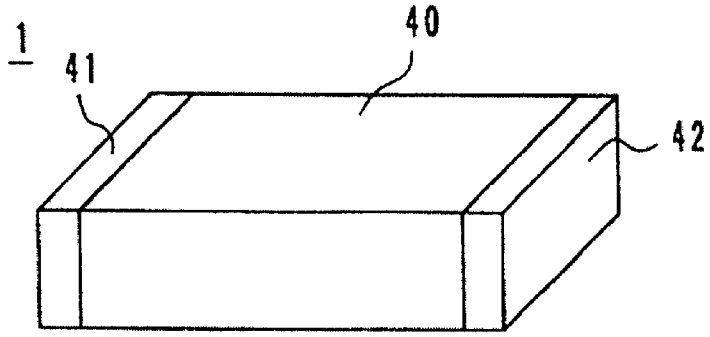
FIG. 2 is an external perspective view of the multilayer impedance component shown in FIG. 1.

As shown in FIG. 1, the magnetic sheets 2 to 12 are stacked and pressed. Then, the sheets are integrally fired, such that a multilayer structure 40 shown in FIG. 2 is obtained. On each of the right and left end surfaces of the multilayer structure 40, an input external electrode 41 and an output external electrode 42 are provided. The input external electrode 41 is connected to a leading end 16*a* of the coil conductor pattern 16 and the output external electrode 42 is connected to a leading end 27*a* of the coil conductor pattern 27.

Figure 3:
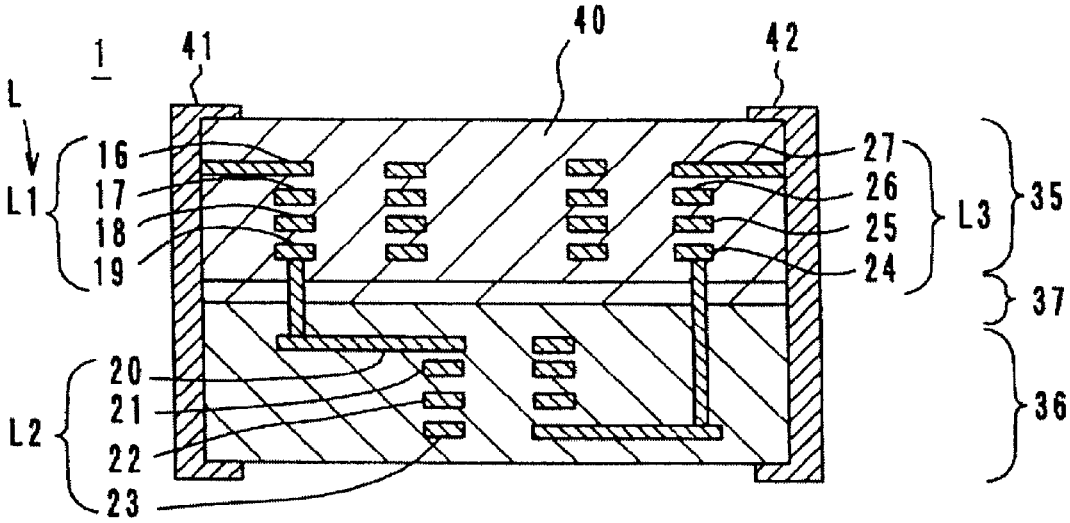
FIG. 3 is a schematic section of the multilayer impedance component shown in FIG. 2.

As shown in FIG. 3, the multilayer impedance component 1 includes the high permeability coil 35 defined by stacking the magnetic sheets 2 to 6 having a relatively high permeability, the low permeability coil 36 defined by stacking the magnetic sheets 8 to 12 having a relatively low permeability, and an intermediate layer 37 defined by an intermediate sheet 7.

The first and third winding portions L1 and L3 of the high permeability coil 35 eliminate low frequency noises and the second winding portion L2 of the low permeability coil 36 eliminates high frequency noises.

Each end of the helical coil L is led from the coil conductor patterns 16 and 27 provided in the high permeability coil portion 35 to each of the input external electrode 41 and the output external electrode 42. Accordingly, the high permeability portions are symmetrical. Consequently, the electrical characteristics are substantially the same regardless of the direction in which the multilayer impedance component 1 is mounted, specifically, the surface used when mounted. Thus, directivity marking is unnecessary. Since the winding direction in the first winding portion L1 of the high permeability coil 35 is opposite to the winding direction in the third winding portion L3 thereof, magnetic flux generated in the first winding portion L1 does not electromagnetically couple with magnetic flux generated in the third winding portion L3. Consequently, a high frequency component input from the input external electrode 41 propagates through the first, second, and third winding portions L1 to L3 in order and is output from the output external electrode 42. As a result, the high frequency component input from the input external electrode 41 is not output from the output external electrode 42 directly by the electromagnetic coupling between the first and third winding portions L1 and L3.

Figure 4:
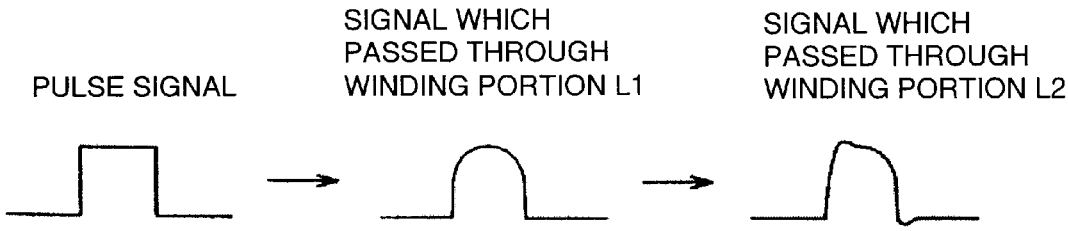
FIG. 4 is an illustration showing changes in the waveform of a pulse wave signal input to the multilayer impedance component shown in FIG. 2.

The input external electrode 41 is electrically connected to the coil conductor pattern 16 of the high permeability coil 35. Thus, when a signal of a pulse wave is input to the multilayer impedance component 1, as shown in FIG. 4, the signal waveform is initially blunt in the first winding portion L1 of the high permeability coil 35 and then is distorted in the second winding portion L2 of the low permeability coil 36.

Generally, the distortion of the signal waveform increases as the signal gets closer to the pulse wave. Thus, the waveform distortion is greater in a multilayer impedance component having the input external electrode connected to the coil conductor pattern of the low permeability coil. In other words, the multilayer impedance component 1 of the first preferred embodiment of the present invention has greatly improved electrical characteristics because a signal is sent to the input external electrode 41, the first winding portion L1 of the high permeability coil 35, the second winding portion L2 of the low permeability coil 36, the third winding portion L3 of the high permeability coil 35, and the output external electrode 42 in that order.

Furthermore, since the relative permeability $\mu$ of the high permeability coil 35 is at least about 300, a damping function is obtained and thereby signal-waveform ringing is effectively prevented. As a result, the quality of signal waveforms is greatly improved. Additionally, since the relative permeability $\mu$ of the low permeability coil 36 is about 100 or less, increased impedance is obtained in a high frequency region (about 100 MHz or higher). Thus, the damping function is also obtained and as a result, greatly improved impedance characteristics are maintained even in the high frequency region.

Preferably, the total impedance of the first and third winding portions L1 and L3 of the high permeability coil 35 is about 220 ohms or less (100 MHz) and the impedance of the second winding portion L2 of the low permeability coil 36 is about 220 ohms or less (100 MHz). This is because a signal level is lower and the signal waveform is blunt when the high permeability coil 35 has an increased impedance. On the other hand, when the low permeability coil 36 has an increased impedance, the slope of the impedance curve increases which causes the Q factor to increase. This prevents the damping function from working properly and therefore waveform distortion is not sufficiently controlled.

Figure 5:
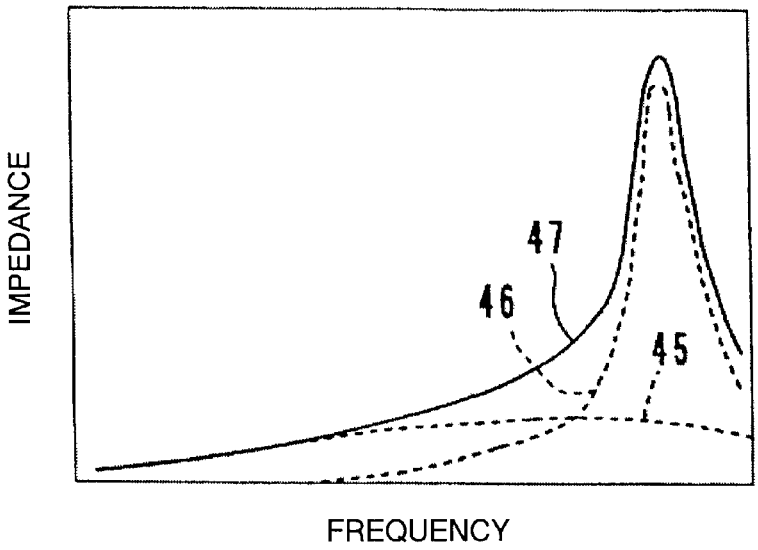
FIG. 5 is a graph showing impedance characteristics of the multilayer impedance component shown in FIG. 2.

FIG. 5 shows impedance characteristics between the external electrodes 41 and 42 of the multilayer impedance component 1 (solid line 47). In FIG. 5, a dotted line 45 indicates impedance characteristics of the high permeability coil 35 and a dotted line 46 indicates impedance characteristics of the low permeability coil 36.

In the multilayer impedance component 1, the intermediate layer 37 made of a non-magnetic material is provided between the high permeability coil 35 and the low permeability coil 36. This configuration prevents electromagnetic coupling between the magnetic flux generated in the first and third winding portions L1 and L3 of the high permeability coil 35 and the magnetic flux generated in the low permeability coil 36. Furthermore, the intermediate layer 37 prevents mutual diffusions between the material of the high permeability coil 35 and the material of the low permeability coil 36, and further, prevents warping and cracking from occurring due to the difference between the shrinkage ratios of the materials.

Figure 6:
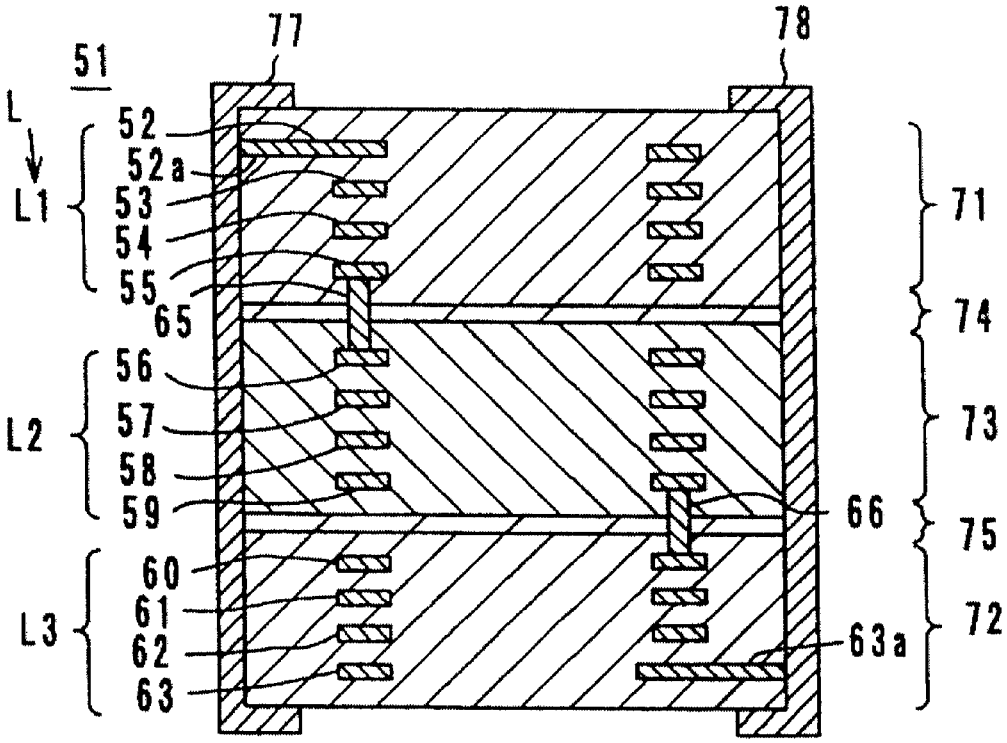
FIG. 6 is a schematic section of a multilayer impedance component according to a second preferred embodiment of the present invention.

As shown in FIG. 6, a multilayer impedance component 51 according to a second preferred embodiment of the present invention is defined by stacking high permeability coils 71 and 72 above and below a low permeability coil 73. Between the high permeability coils 71 and 72 and the low permeability coil 73, intermediate layers 74 and 75 made of a material such as glass or glass ceramic are provided.

The high permeability coil 71 is defined by stacking high permeability magnetic sheets having coil conductor patterns 52 to 55 provided thereon. The coil conductor patterns 52 to 55 are electrically connected in series through via-holes (not shown) provided in the magnetic sheets to define a first winding portion L1 of the high permeability coil 71.

The high permeability coil 72 is defined by stacking high permeability magnetic sheets having coil conductor patterns 60 to 63 provided thereon. The coil conductor patterns 60 to 63 are electrically connected in series through via-holes (not shown) provided in the magnetic sheets to define a third winding portion L3 of the high permeability coil 72.

The low permeability coil 73 is defined by stacking low permeability magnetic sheets having coil conductor patterns 56 to 59 provided thereon. The coil conductor patterns 56 to 59 are electrically connected in series through via-holes (not shown) provided in the magnetic sheets to form a second winding portion L2 of the low permeability coil 73.

The first winding portion L1, the second winding portion L2, and the third winding portion L3 are electrically connected in series through via-holes 65 and 66 provided in the magnetic sheets to define a helical coil L. A leading end 52*a* of the coil conductor pattern 52 is electrically connected to an input external electrode 77 and a leading end 63*a* of the coil conductor pattern 63 is electrically connected to an output external electrode 78.

In the multilayer impedance component 51 having the above-described configuration, the coil axis of the helical coil L is substantially parallel to the direction in which the magnetic sheets are stacked and also substantially parallel to the input and output external electrodes 77 and 78 to define an inductor having a longitudinally-wound structure. The multilayer impedance component 51 achieves the same advantages as those of the impedance element 1 of the first preferred embodiment.

Figure 7:
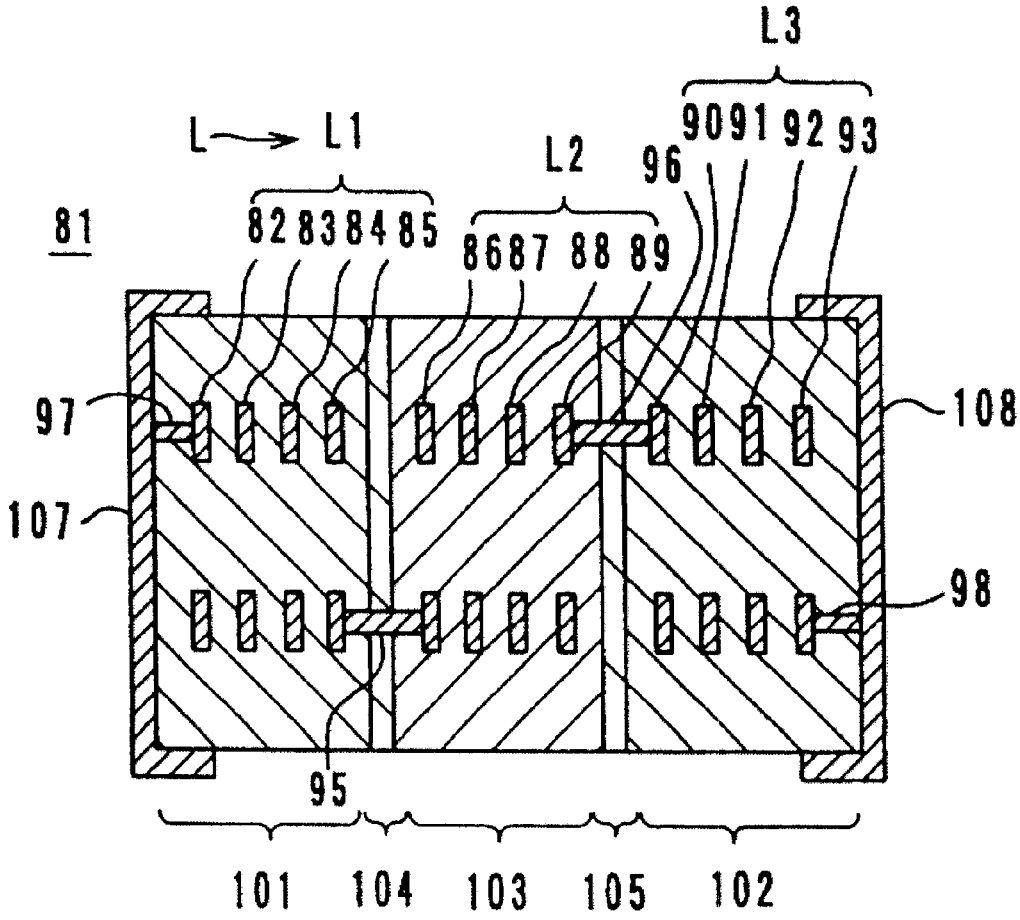
FIG. 7 is a schematic section of a multilayer impedance component according to a third preferred embodiment of the present invention.

As shown in FIG. 7, a multilayer impedance component 81 according to a third preferred embodiment of the present invention includes high permeability coils 101 and 102 on each side of a low permeability coil 103. Between the high permeability coils 101 and 102 and the low permeability coil 103, intermediate layers 104 and 105 made of a nonmagnetic material such as glass or glass ceramic are provided.

The high permeability coil 101 is defined by stacking high permeability magnetic sheets having coil conductor patterns 82 to 85 provided thereon. The coil conductor patterns 82 to 85 are electrically connected in series through via-holes (not shown) provided in the magnetic sheets to form a first winding portion L1 of the high permeability coil 101.

The high permeability coil 102 is defined by stacking high permeability magnetic sheets having coil conductor patterns 90 to 93 provided thereon. The coil conductor patterns 90 to 93 are electrically connected in series through via-holes (not shown) provided in the magnetic sheets to form a third winding portion L3 of the high permeability coil 102.

The low permeability coil 103 is defined by stacking high permeability magnetic sheets having coil conductor patterns 86 to 89 provided thereon. The coil conductor patterns 86 to 89 are electrically connected in series through via-holes (not shown) provided in the magnetic sheets to form a second winding portion L2 of the low permeability coil 103.

The first winding portion L1, the second winding portion L2, and the third winding portion L3 are electrically connected in series through via-holes 95 and 96 provided in the magnetic sheets to define a helical coil L. The coil conductor pattern 82 is electrically connected to an input external electrode 107 through a leading via-hole 97 provided in the magnetic sheet and the coil conductor pattern 93 is electrically connected to an output external electrode 108 through a leading via-hole 98 provided in the magnetic sheet.

In the multilayer impedance component 81 having the above-described structure, the coil axis of the helical coil L is substantially parallel to the direction in which the magnetic sheets are stacked and substantially perpendicular to the input and output external electrodes 107 and 108 to define an inductor having a horizontally-wound structure. The multilayer impedance component 81 achieves the same advantages as those of the impedance element 1 of the first preferred embodiment.

The multilayer impedance component of the present invention is not restricted to the above-described preferred embodiments and can be modified within the scope of the invention. For example, the numbers of turns in a coil and the configurations of coil conductor patterns can be changed depending on specifications. In each of the above-described preferred embodiments, the helical coil is formed by connecting the coil conductor patterns. However, spiral coil conductor patterns with one or more turns may be provided on magnetic sheets. Alternatively, with via-holes or printing patterns, straight-line coil conductor patterns may be used to define a coil. Furthermore, helical, spiral, and straight-line coil conductor patterns may be combined to define a coil.

In addition to the multilayer inductors of the above-described preferred embodiments, the multilayer impedance component of the present invention includes multilayer common-mode choke coils, multilayer LC composite components, and other suitable components.

In addition, in the above-described preferred embodiments, the relative permeability of the high permeability coil is preferably at least about 300. However, the invention is not limited to this case. The relative permeability of the high permeability coil may be about 100 to about 300. In this situation, in addition to the impedance peak of the coil L, inductance of the high permeability coil resonates with stray capacitance generated electrically in parallel to the inductance. Consequently, another impedance peak is provided on the frequency side lower than the impedance peak. As a result, the multilayer impedance component has steeper impedance characteristics.

Furthermore, in the above-described preferred embodiments, although the magnetic sheets having the coil conductor patterns provided thereon are stacked and then integrally fired, the present invention is not limited to this case. The magnetic sheets used in the present invention may be fired in advance. Additionally, instead of that, the impedance element may be formed by the following method. After magnetic sheets made of a paste magnetic material are formed by printing or other suitable method, a paste conductive material is applied on the magnetic sheets to form coil conductor patterns. Next, the paste magnetic material is applied on the coil conductor patterns to form magnetic layers including the coil conductor patterns. Similarly, while electrically connecting the coil conductor patterns with each other, sequential application of the paste magnetic material enables the formation of an impedance element having a multilayer structure.

As described above, in the present invention, since the input and output external electrodes are electrically connected to the first and third winding portions of the high permeability coil, the waveform of a signal input from the input and output external electrodes is slightly distorted. Thus, the multilayer impedance component produces greatly improved electrical characteristics. In addition, since each end of the coil is led from the first and third winding portions of the high permeability coil to the input and output external electrodes, the portions are symmetrical. Consequently, the electrical characteristics are substantially the same regardless of the direction in which the multilayer impedance component is mounted (the surface used when mounted).

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A multilayer impedance component comprising:

a high permeability coil unit including at least one first winding portion and at least one third winding portion defined by a stack of a plurality of magnetic layers made of a relatively high permeability material and a plurality of coil conductor patterns; and a low permeability coil unit including at least one second winding portion defined by a stack of a plurality of magnetic layers made of a relatively low permeability material and a plurality of coil conductor patterns;

wherein the high permeability coil unit and the low permeability coil unit are stacked such that the first, second, and third winding portions are electrically connected in series in a sequential manner to define a coil, the first winding portion and the third winding portion of said high-permeability coil unit are connected to input and output external electrodes.

2. The multilayer impedance component according to claim 1, further comprising an intermediate layer made of a nonmagnetic material provided between the high permeability coil unit and the low permeability coil unit.

3. The multilayer impedance component according to claim 1, wherein the plurality of the coil conductor patterns of the high permeability coil unit are connected in series through via holes provided in the plurality of magnetic layers of the high permeability coil unit.

4. The multilayer impedance component according to claim 1, wherein the plurality of the coil conductor patterns of the low permeability coil unit are connected in series through via holes provided in the plurality of magnetic layers of the low permeability coil unit.

5. The multilayer impedance component according to claim 1, wherein the at least one first winding portion and the at least one second winding portion are wound in a clockwise direction and the third winding portion is wound in a counterclockwise direction.

6. The multilayer impedance component according to claim 1, wherein the at least one first winding portion is connected to the at least one second winding portion through a via hole provided in one of the plurality of magnetic layers, and the at least one second winding portion is connected to the at least one third through a via hole provided in another of the plurality of magnetic layers.

7. The multilayer impedance component according to claim 1, wherein the relative permeability $\mu$ of the high permeability coil unit is at least about 300.

8. The multilayer impedance component according to claim 1, wherein the relative permeability $\mu$ of the low permeability coil unit is about 100 or less.

9. The multilayer impedance component according to claim 1, wherein the total impedance of the at least one first winding portion and the at least one third winding portion of the high permeability coil unit is about 220 ohms or less.

10. The multilayer impedance component according to claim 1, wherein the impedance of the at least one second winding portion of the how permeability coil unit is about 220 ohms or less.

* * * * *